US005361551A

United States Patent [19]

Post

[11] Patent Number: 5,361,551

[45] Date of Patent: Nov. 8, 1994

[54] VENTILATION SPACER FOR ROOF CONSTRUCTION

[76] Inventor: Joseph Post, 5 Rogers Ave., Billerica, Mass. 01821

[21] Appl. No.: 579,478

[22] Filed: Sep. 7, 1990

Related U.S. Application Data

[63] Continuation-in-part of Ser. No. 461,064, Jan. 4, 1990, abandoned.

[51] Int. Cl.[5] ..... E04D 13/16

[52] U.S. Cl. ..... 52/95; 52/302.1; 52/302.6; 52/807; 454/260

[58] Field of Search ..... 52/302, 305, 95, 631, 52/793, 800, 807, 808, 817, 169.5, 57, 302.1, 302.6; 454/260, 242, 365

[56] References Cited

U.S. PATENT DOCUMENTS

| | | | |
|---|---|---|---|
| 317,868 | 5/1985 | Smith . | |
| 537,488 | 4/1995 | Hayes . | |
| 3,574,103 | 4/1971 | Latkin | 161/43 |
| 3,641,720 | 2/1972 | Berrie | 52/122 |
| 3,654,765 | 4/1972 | Healy et al. | 52/169.5 |
| 4,245,443 | 1/1981 | Beechen | 52/169.5 |
| 4,406,095 | 9/1983 | Slavik | 52/95 |
| 4,418,505 | 12/1983 | Thompson | 52/95 |
| 4,607,566 | 8/1986 | Bottomore et al. | 98/37 |
| 4,817,506 | 4/1989 | Cashman | 52/199 |
| 4,995,308 | 2/1991 | Waggoner | 52/95 |

FOREIGN PATENT DOCUMENTS

2136588 A 9/1984 United Kingdom ..... F24F 7/02

OTHER PUBLICATIONS

Attic and Roof Ventilation Products, 4th Edition, Air Space Vent, Inc. A CertainTeed Company, 1987.

*Primary Examiner*—Michael Safavi

*Attorney, Agent, or Firm*—Wolf, Greenfield & Sacks

[57] ABSTRACT

A ventilation spacer for placement between a facia board and the roof sheathing of a roof construction comprising a strip of corrugated metal or plastic having slits cut therein in a longitudinal direction and bent to a 90° angle along the line defined by the slits.

4 Claims, 4 Drawing Sheets

VENTILATION SPACER FOR ROOF CONSTRUCTION

RELATED APPLICATION

This is a continuation-in-part of U.S. patent application Ser. No. 07/461,064.

FIELD OF THE INVENTION

The invention relates to roofing ventilation. More particularly, the invention relates to a spacer positioned between roof sheathing and the facia board of a roof construction for providing ventilation by outside air of the underside of the planks of roof sheathing.

BACKGROUND OF THE INVENTION

In the construction of roofs, it is typical to provide means by which outdoor air can circulate along the underside of the planks of roof sheathing. Due to the high thermal efficiency of modern thermal insulation commonly used in roof constructions, moisture can get trapped under the roof and condense into the insulation. The condensed moisture can damage both the insulation and the roof sheathing and is thus undesirable. The passage of air along the underside of the roof sheathing helps prevent moisture condensation in the thermal insulation and thus increases the life of the roof.

In addition, in the absence of proper ventilation, warm air from within a building structure, such as a house, is often trapped in pockets beneath the sheathing, causing certain areas of the roof to be warmer than other areas. In cold weather, such conditions may cause ice on the roof to melt in the warm areas. The water from the melted ice flows down to cooler areas where it refreezes creating an ice dam. Additional quantities of water from the melting ice backs up behind the dam and freezes underneath the shingles or other roofing panel, causing water build up and leaks in the roof and possibly structural and cosmetic damage to the building.

In view of these problems, it is now common practice to provide air circulation vents adjacent the roof sheathing which communicate with the outdoor air and through which the outdoor air flows. A typical roof air circulation vent is provided by nailing or stapling a metal or plastic form to the roof sheathing in between pairs of adjacent roof rafters. The metal or plastic form includes flanges at opposite ends which can be nailed to the roof sheathing. Between the flanges, the form extends away from the sheathing to form an empty space between the form and the roof sheathing. Thermal insulation is either laid or blown into the space below the vent form, i.e., between the vent form and the ceiling of the building. The eaves of the roof are provided with some means for allowing the outdoor air to communicate with the vents.

U.S. Pat. No. 4,406,095, for instance, discloses a vent for placement between rafters which does not require nails or staples and which is formed in an undulated shape for added strength to prevent collapsing of the vent towards the roof sheathing under the force of thermal insulation being blown beneath the vent.

Another patent, U.S. Pat. No. 4,607,566, discloses a ventilator for placement at the eaves of the roof, between the roof sheathing and the facia board that allows outdoor air to reach the vents. The device comprises a ventilator overlying the facia board of a roof construction. This ventilator has a series of passages which allow the outdoor air to flow through it between the roof sheathing and the facia board, into the internal area of the roof construction where vents, such as the ones described in U.S. Pat. No. 4,406,095 discussed above, are positioned. This provides a path for the air along the underside of the sheathing.

The ventilator disclosed in U.S. Pat. No. 4,607,566 is complicated in structure and expensive to manufacture. Thus, it is an object of the present invention to provide a simple, low cost ventilation spacer for installation between the roof sheathing and the facia board of a roof construction to allow outdoor air to reach vents positioned along the underside of the roof sheathing.

It is another object of the present invention to provide an improved ventilation spacer for a roof construction which is simple to fabricate, install and store and which is not likely to be damaged in the ordinary course of use and handling.

SUMMARY OF THE INVENTION

The invention comprises a ventilation spacer for insertion between a facia board and the roof sheathing in a roof construction for providing passages through which outdoor air can flow into the internal area of the roof and particularly into the vents along the underside of the roof sheathing. The spacer is formed of an elongated strip of resilient metal or plastic formed into an undulated (or corrugated) shape having a series of slits cut longitudinally therein along a longitudinal fold line of the spacer with each slit centered at the peak of an undulation and extending to either side of the peak.

The series of slits allows the strip of metal to be bent to a right angle, the axis of the angle being along the fold line coextensive with the slits. Thus, the spacer is formed into first and second sections disposed at a right angle to each other. The spacer is then attached to the facia board such that it conforms with the corner of the facia board defined by the outer surface and the upper surface of the facia board. The ends of the planks of roof sheathing are then laid on top of the spacer in contacting relationship with the first section of the spacer which rests on the upper surface of the facia board. When flashing is placed between the underside of the roof planks and the facia board, the flashing rather than the planks contacts the first section of the spacer. Also, the portion of the flashing which would normally contact the facia board instead contacts the second section of the spacer which rests along the outer surface of the facia board. In this manner channels are provided for outdoor air to flow between the facia board and the flashing (or planks, if no flashing is used).

Specifically, due to the undulated configuration of the strip of material which forms the spacer, the planks of roof sheathing (or flashing) contact the spacer at defined points (i.e., the peaks of the undulations) and channels are formed between the spacer and the roof sheathing (or flashing) between the peaks. These channels allow outdoor air to pass between the facia board and the roof sheathing and flow internally of the roof within air circulation vents positioned along the underside of the sheathing.

Alternately, the spacer may be formed of two webs having support means therebetween to space them apart from each other the support means defining transverse channels for allowing air to pass between the two sheaths.

DETAILED DESCRIPTION OF THE INVENTION

Figure 1:
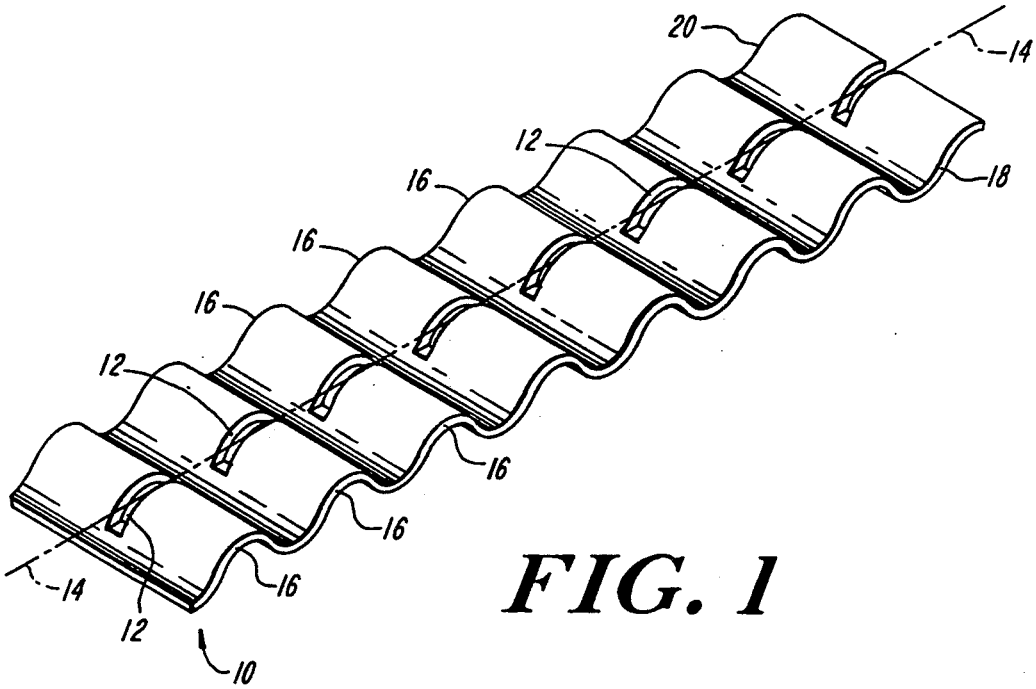
FIG. 1 shows a perspective view of the ventilation spacer of the present invention before it is folded over to form a 90° angle.
Figure 2:
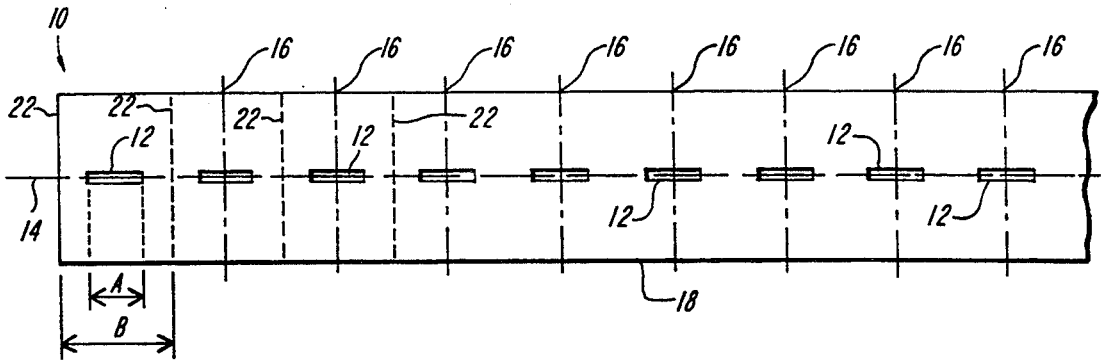
FIG. 2 shows a plan view of the ventilation spacer of the present invention before it is folded over to form a 90° angle.

FIGS. 1 and 2 show a perspective and a plan view, respectively, of a strip of undulated metal or plastic having slits intermittently cut therein. The metal or plastic must be maleable such that the strip 10 can be bent along the line 14—14 to a 90° angle. The slits are cut longitudinally of the strip 10 and are centered at the peaks 16 of each undulation and are positioned halfway between opposite longitudinal sides 18 and 20 of the strip 10. The slits 12 are of a length A which is approximately one half the length B of each undulation. The slits 12 may be substantially longer than one half length B, however, the amount of material (metal or plastic) between adjacent slits must be sufficient to provide structural rigidity to the spacer 10. If too little material is between adjacent slits, the spacer 10 may snap in half when folded.

Figure 3:
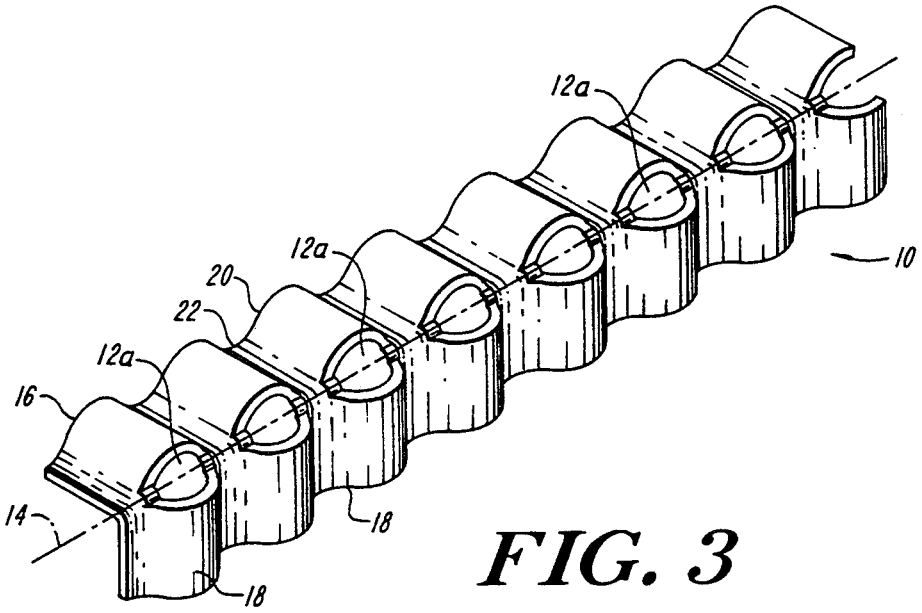
FIG. 3 shows a perspective view of the ventilation spacer of the present invention after being folded into its useful shape.

To form the strip 10 into its usable shape as a spacer, it is bent along line 14—14 to form a 90° angle as shown in FIG. 3. When bent into this shape, the slits 12 open up to form larger holes 12*a*.

In a preferred embodiment, the strip 10 is made of corrugated, galvanized aluminum or tin since such sheets are commonly used for roofing material and other purposes and, therefore, are readily available and inexpensive.

Figure 4:
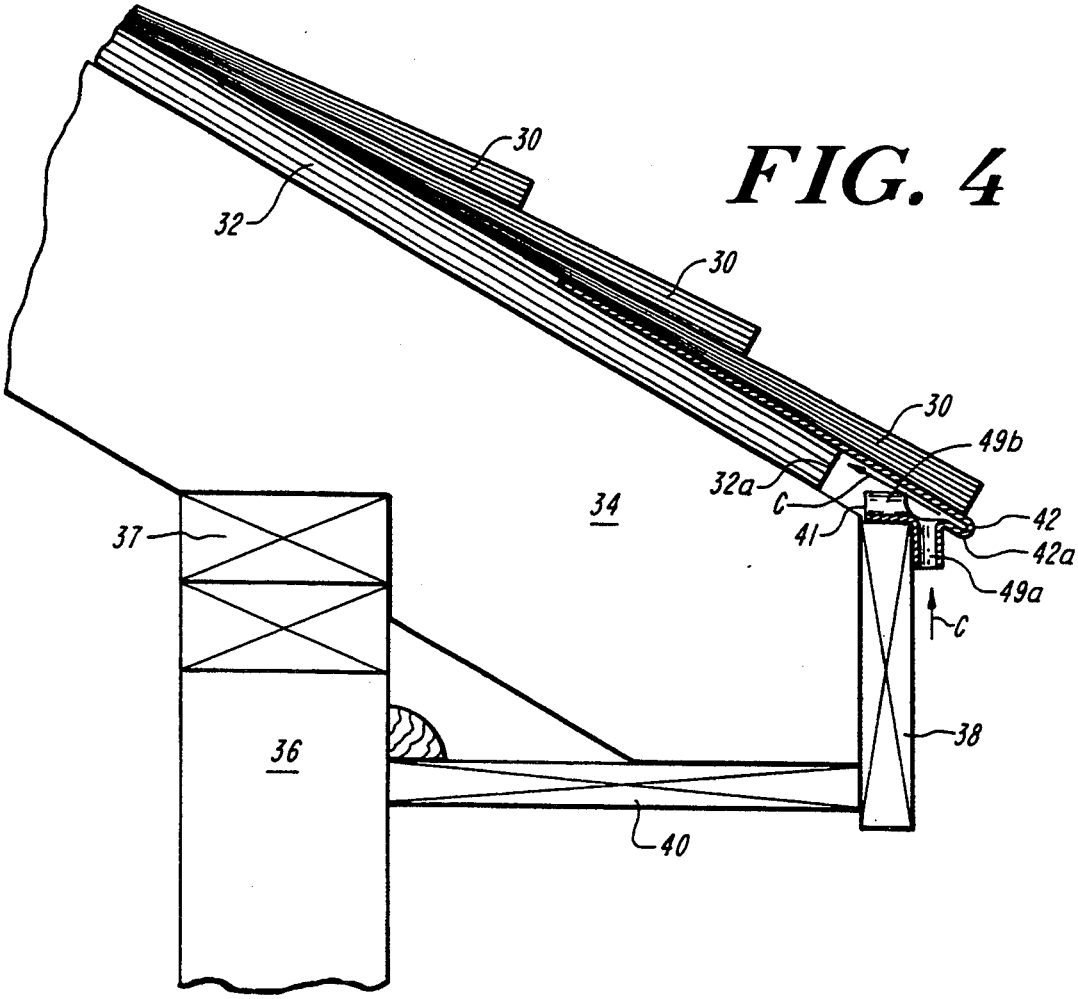
FIG. 4 shows a side view of an exemplary roof construction embodying the ventilation spacer of the present invention.

FIG. 4 illustrates the spacer embodied in a roof construction. The roof construction comprises roofing materials such as shingles 30 laid over roof sheathing 32. The roof sheathing 32 is attached to rafters 34 of which one is shown in FIG. 4. A stud is shown at 36 atop of which a wall plate 37 is placed. A facia board 38 is attached to a soffit board 40 which is, in turn, attached to stud 36.

Flashing 42 is placed between the sheathing 32 and the shingles 30 near the outer end of the roof construction. The flashing 42 is shaped to prevent rain water running off of the shingles 30 from reaching the underside of the shingles 30. The ventilation spacer of the present invention is shown at 41 attached to the facia board 38. The spacer 41 may be nailed or stapled to the facia board 38. The flashing 42 is placed over the spacer 41 as shown in FIG. 4. Due to the undulated shape of the spacer 10, the flange contacts the spacer 41 only at the peaks 16 shown in FIGS. 1, 2 and 3. Channels for air circulation are defined between adjacent peaks 16 of the spacer. Thus, there is a plurality of channels between the spacer 41 and the flashing 42 as well as between the spacer 41 and the facia board 38. As shown in FIG. 4, the flashing 42 contacts each peak 16 of the spacer 41 at two distinct points, indicated at 49*a* and 49*b* forming two sets of channels. Air flows in the direction of arrows C in FIG. 4 through a first set of channels between the flashing and the facia board at 49*b* and then through a second set of channels between the facia board and the flashing at 49*a* and up into the air circulation vents which are positioned between adjacent rafters 34.

Although FIG. 4 shows a side view of the roof construction, it should be understood that there are a plurality of rafters 34, and a plurality of planks of roof sheathing 32 which extend the entire length of the roof. Spacer 10 and flashing 42 also extend perpendicular to the page for the length of the roof.

Although FIG. 4 shows the ends 32A of the plank of roof sheathing 32 terminating short of the facia board 38 and spacer 41, it should be understood that in other roof constructions, the sheathing 32 may extend beyond the facia board 38 and thus would rest on the spacer 41 rather than the flashing 42. It should also be understood that the invention would work equally as well in a roof construction without flashing. In such a situation, the planks 32 would simply extend beyond the facia board and rest on the spacer 41.

The spacers can be manufactured by cutting corrugated aluminum or tin sheets perpendicular to the corrugation and cutting slits along the line 14—14 halfway between the longitudinal sides 18 and 20 of the strip. The slits can be cut into the spacer 10 inexpensively and quickly by placing the strip on a flat planar surface and placing a radial-arm saw or the like a fixed height above the surface. The strip can then be passed under the rotating saw blade in the direction of line 14 in FIGS. 1 and 2 and the saw will cut the slits at the peaks of the undulations. Thus, all the slits in a given strip can be cut therein by one pass under a radial saw fixed at a specified height. The height of the saw above the surface and the vertical distance between the peaks 16 and valleys 22 of the strip 10 determine the length of the slits. For example, to cut slits of length A, where A is one half length B, the radial saw blade is set to one half the vertical distance between the peaks 16 and valleys 22 of the strip. The spacer can be sold as part of the flange or as a separate unit.

Figure 5:
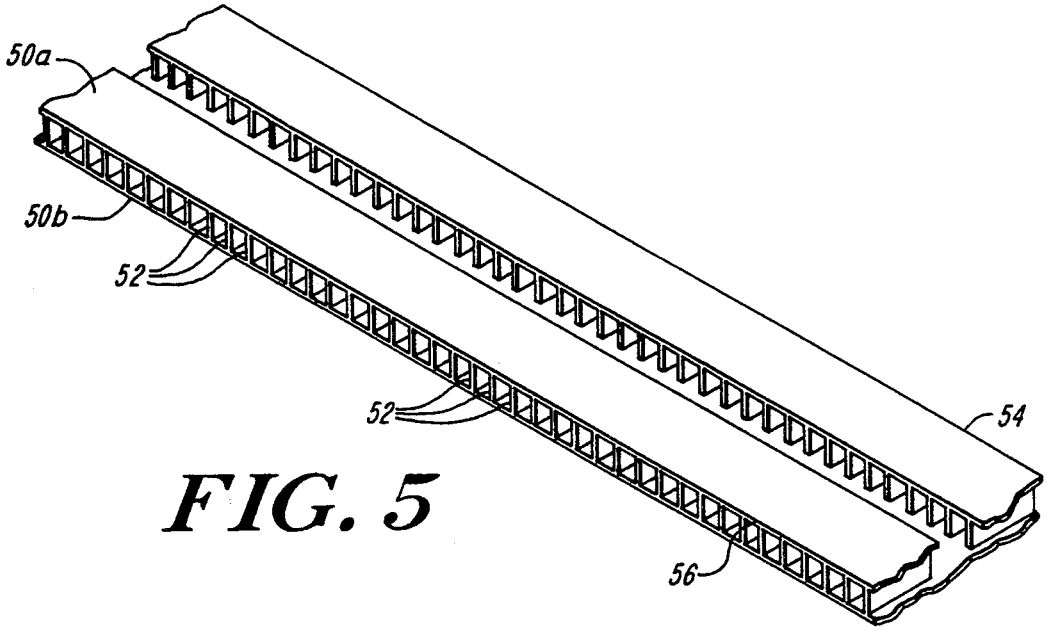
FIG. 5 shows a perspective view of a second embodiment of the ventilation spacer of the present invention before it is folded to form a 90° angle.
Figure 6:
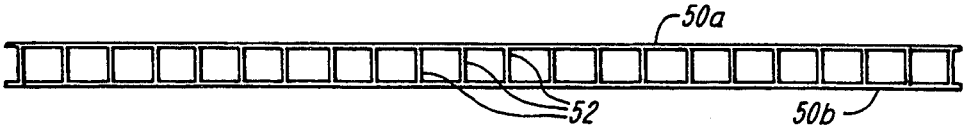
FIG. 6 shows a side view of the ventilation spacer shown in FIG. 5 before it is folded.
Figure 7:
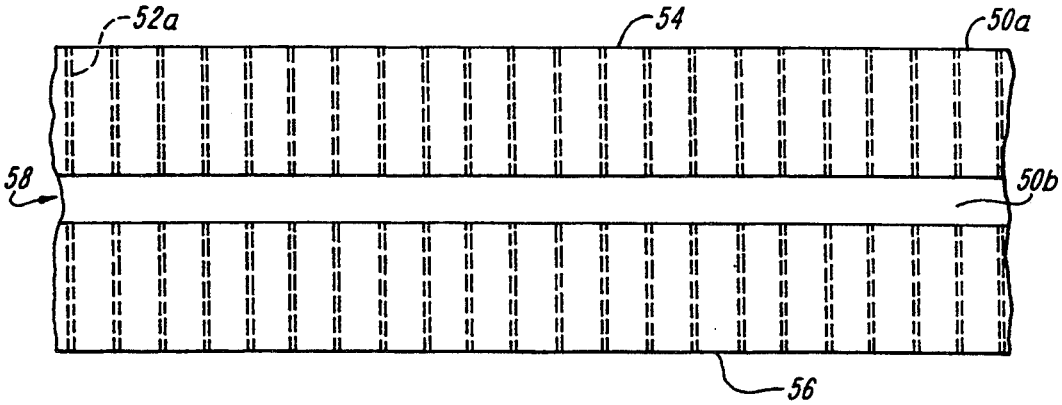
FIG. 7 shows a plan view of the ventilation spacer shown in FIG. 5.

FIGS. 5, 6 and 7 illustrate another embodiment of the present invention. This embodiment comprises two webs of material 50*a* and 50*b* having a plurality of supporting means 52 therebetween. The supporting means 52 and the material 50*a* and 50*b* may be constructed of the same material, such as a malleable plastic or metal. The supporting means 52 must be strong enough to support the strips 50*a* and 50*b* in spaced relation to each other under the pressure and weight of the roof or flashing. As in the previously described embodiment, the spacer is folded to a 90° angle along a fold line longitudinal of the strips 50*a* and 50*b*. In the preferred embodiment, the fold line is half way between the edges 54 and 56. In order to facilitate the folding of the spacer, one of the strips, e.g., 50*b*, has a narrow slit 58 cut in it proximate the desired fold line, as shown in FIGS. 5 and 7. Further, the support means 52 are discontinuous at the slit to facilitate folding without blocking the path of the air. As shown in FIG. 7, support means 52*a*, for instance, extends from edge 54 to edge 56 but is discontinuous in the area proximate the slit. The spacer can be folded along the fold line to form a 90° angle with web 50*b* forming either the inside or outside corner.

Figure 8:
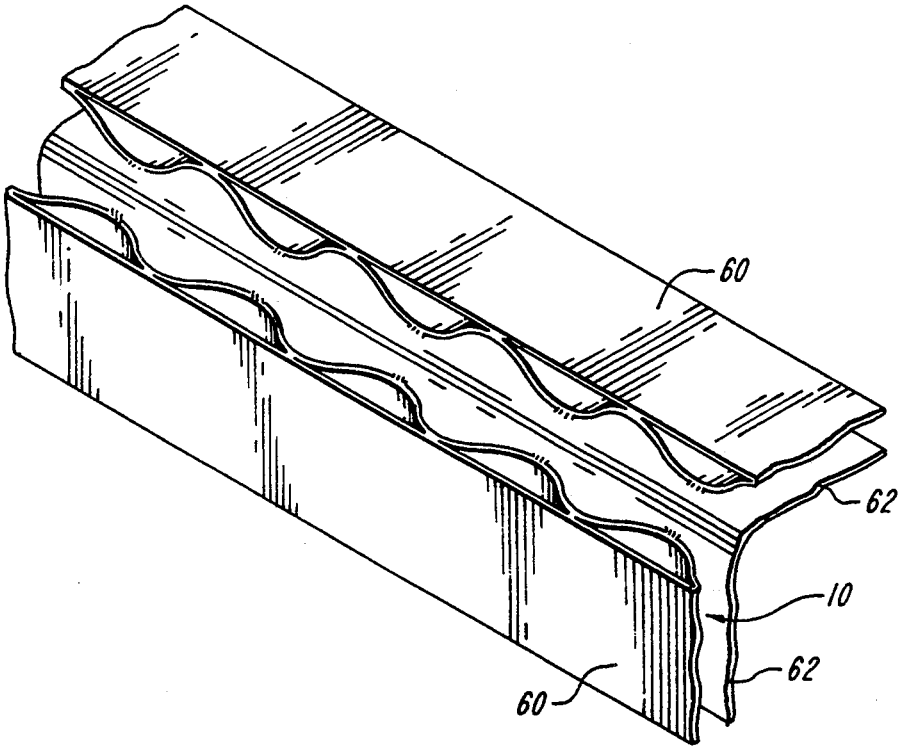
FIG. 8 shows a further embodiment of the ventilation spacer of the present invention.

FIG. 8 shows a further embodiment of the present invention which essentially comprises the spacer 10 of FIG. 1 sandwiched between two webs of material 60 and 62. In FIG. 8, the corrugated strip is shown as being completely severed at the fold line. However, it should be clear that the corrugated strip may merely have slits cut in it at the peaks as shown in FIGS. 1, 2 and 3. One of the strips 60 or 62 has a longitudinal slit cut in it along the fold line defined by the slits cut in the spacer 10. The slit in strip 60 or 62 is similar to the slit 58 shown in FIG. 6 and facilitates in the folding of the device without causing blockage of the air path. This embodiment provides significantly increased contact area for attaching the spacer to the facie board, roof planks or flashing, as the case may be.

Having thus described a few preferred embodiments of the invention, various alterations, modifications and improvements will readily occur to those skilled in the art. For instance, the spacer 10 need not be corrugated on both surfaces. If the spacer was corrugated on only one surface there would be half as many channels as a fully corrugated spacer. However, the device would operate in exactly the same manner. Such alterations, modifications and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

What is claimed is:

1. A roof construction comprising:
a fascia board,
roof shingles,
flashing positioned beneath said roof shingles,
a unitary ventilation spacer positioned between said fascia board and said flashing, said spacer comprising,
a first continuous elongated web;
a second elongated web spaced from said first web;
support means between said first and second webs supporting and securing said first and second webs apart from each other, said support means defining channels transverse said elongated webs; and
said support means and said second web being discontinuous at a fold line intermediate said elongated webs, whereby said ventilation spacer can be folded.

2. A roof construction as set forth in claim 1 wherein said ventilation spacer is comprised of plastic.

3. A roof construction as set forth in claim 2 wherein said fold line is halfway between longitudinal edges of said spacer.

4. A roof construction comprising:
a fascia board,
roof shingles,
a unitary ventilation spacer positioned between said fascia board and said roof shingles, said spacer comprising an elongated member adapted to be folded along a line longitudinal of said elongated member, said elongated member comprising a plurality of spaced elements defining air passages therebetween which are transverse to said elongated member, thereby allowing air to pass transversely through said ventilation spacer between said roof and said fascia board.

* * * * *